US005334968A

United States Patent [19]

Negoro

[11] Patent Number: 5,334,968

[45] Date of Patent: Aug. 2, 1994

[54] CHIP NETWORK-TYPE RESISTOR ARRAY

[75] Inventor: Masayuki Negoro, Kyoto, Japan

[73] Assignee: Rohm Co., Ltd., Kyoto, Japan

[21] Appl. No.: 14,346

[22] Filed: Feb. 5, 1993

[30] Foreign Application Priority Data

Mar. 2, 1992 [JP] Japan ..... 4-044527

[51] Int. Cl.[5] ..... H01C 1/01

[52] U.S. Cl. ..... 338/320; 338/260; 338/333; 29/610.1; 29/613; 29/619; 29/621

[58] Field of Search ..... 338/260, 295, 319, 320, 338/333; 29/610.1, 613, 619, 621

[56] References Cited

U.S. PATENT DOCUMENTS 3,964,087 6/1976 Mallon ..... 338/320 X
4,228,418 10/1980 Piedmont et al. ..... 338/320 X
4,658,234 4/1987 Takayanagi ..... 338/320 X

*Primary Examiner*—Marvin M. Lateef
*Attorney, Agent, or Firm*—Brumbaugh, Graves, Donohue & Raymond

[57] ABSTRACT

A network-type resistor array in which a plurality of resistors are successively arranged, in which electrode portions of the resistors are respectively separated by angular electrode-separating notches, so as to prevent the short-circuit between the adjacent electrode portions due to the flowing along of molten solder for electrode connection.

4 Claims, 4 Drawing Sheets

CHIP NETWORK-TYPE RESISTOR ARRAY

BACKGROUND OF THE INVENTION

The present invention relates to a chip network-type resistor array formed by successively arranging a plurality of resistors.

FIG. 4 is a perspective diagram showing a conventional chip network-type resistor array. As for this chip network-type resistor, by using a pair of mating dies 7 (an upper die 71 having pins 71*a* and a lower die 72 having recesses 72*a*) as shown in FIG. 6, slits 61 and through holes 62 provided in the slits 61 are formed (see FIG. 5) so that predetermined network resistors can be obtained with respect to a substrate 6. As a result, a network-type resistor array in which five resistors are successively arranged, as shown in FIG. 4, is obtained. In each resistor 1 of this network-type resistor array, electrode portions 2 are respectively formed on both side surfaces thereof, and an unillustrated resistor portion, which straddles upper end surfaces of the mutually opposing electrode portions 2, is formed. In the respective network-type resistor arrays separated from each other by the slits 61 and the through holes 62, adjacent ones of the electrode portions 2 of each resistor array are each separated by an electrode-separating notch 4 whose planar configuration is semicircular (semicylindrical) or semielliptical (see FIGS. 4 and 3).

In this chip network-type resistor array, each of the electrode portions 2 of an upper side portion shown in FIG. 3 is solder-connected as a common-use electrode, while each of the electrodes 2 of a lower side portion is solder-connected as an individual-use electrode, and they are connected and used as resistors for different portions.

With the above-described conventional chip network-type resistor array, a round rod pin (upper die 71) 71*a* such as the one shown in FIG. 9A is used to form the through hole 62 in the substrate 6. Accordingly, the electrode portions 2 of the successively arranged resistors 1 are respectively separated via the semicircular (semicylindrical) or semielliptical electrode-separating notches 4 (see FIG. 4). If, as shown in FIG. 8, solder 5 is applied when each of the electrode portions is electrically connected to the individual-use or common-use electrode, since the notch 4 is formed with a curved surface 41, there has been a disadvantage in that molten solder 5 flows along the notched curved surface 41 continuing between the adjacent electrode portions 2, thereby possibly resulting in a short-circuit.

SUMMARY OF THE INVENTION

An object of the present invention is to overcome the above-described drawback and to provide a chip network-type resistor array which is free from the risk of a short-circuit between adjacent electrode portions.

To attain this object, the chip network-type resistor array of the present invention comprises a plurality of resistors being successively arranged and electrode portions of the resistors being respectively separated by angular notches.

In the chip network-type resistor array having the above-described configuration, adjacent ones of the electrode portions of the plurality of successively arranged resistors are respectively separated by angular notches, i.e., recessed notches whose three surfaces are formed as orthogonal surfaces (electrode-separating notches). Accordingly, when each of the electrode portions is electrically connected to the common-use electrode or individual-use electrode, even if the amount of solder, when applied, is large and the molten solder flows out to the notch, since the notch has its three surfaces arranged orthogonally and is not continuous as in the case of a curved surface. Hence, the solder which has flowed out is prevented from further flowing along by means of the orthogonal corner portion where the side surfaces meet at right angles, thereby making it possible to overcome the risk of a short-circuit.

DESCRIPTION OF THE PREFERRED EMBODIMENT

Figure 2:
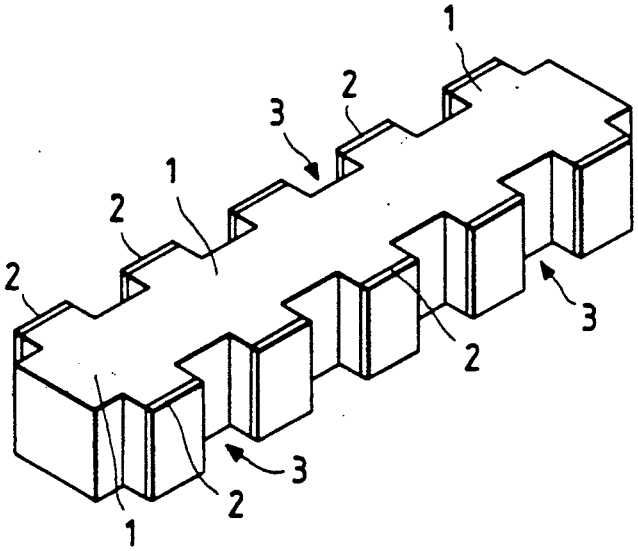
FIG. 2 is perspective view showing the chip network-type resistor array in accordance with the embodiment.
Figure 3:
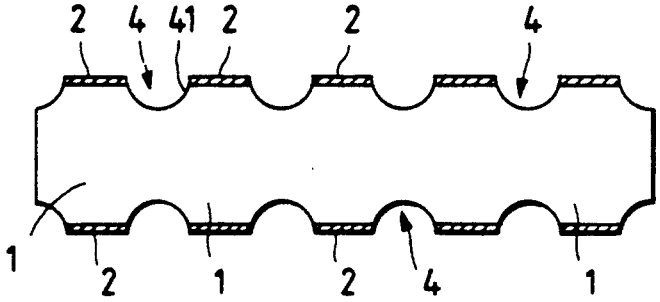
FIG. 3 PRIOR ART
FIG. 3 is a plan view showing a conventional chip network-type resistor array.
Figure 4:
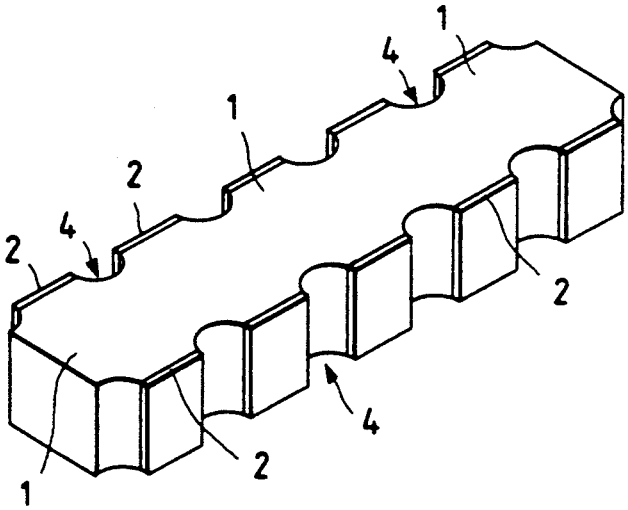
FIG. 4 PRIOR ART
FIG. 4 is a perspective view showing the conventional chip network-type resistor array.
Figure 5:
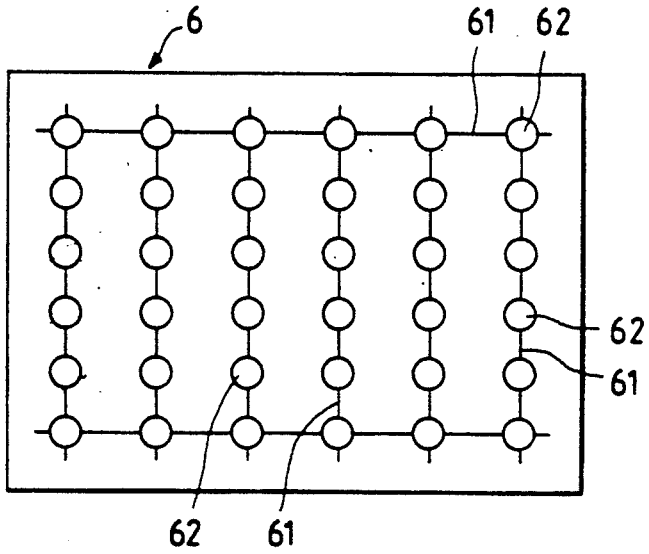
FIG. 5 is a plan view showing a substrate prior to the taking out of the network-type resistor arrays.
Figure 6:
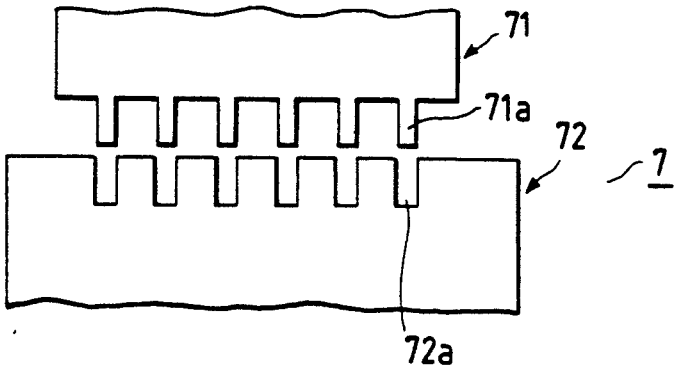
FIG. 6 is an explanatory diagram showing dies for providing separating notches in the substrate.

FIG. 2 is a perspective view showing an embodiment of a chip network-type resistor array in accordance with the present invention.

Figure 1:
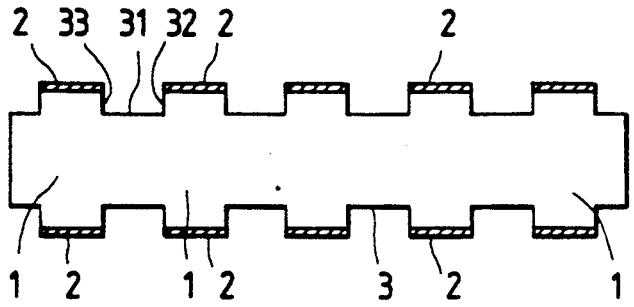
FIG. 1 is a plan view showing a chip network-type resistor array in accordance with an embodiment.
Figure 9A:
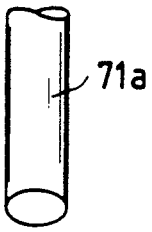
FIG. 9A PRIOR ART
FIGS. 9A and 9B are explanatory diagrams illustrating boring pins of an upper die.
Figure 9B:
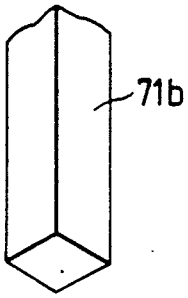

In the chip network-type resistor array, slits and through holes provided in the slits are formed in the substrate by means of an upper and a lower die in a known manner. As portions surrounded by the slits and the through holes are taken out, a plurality of network resistor arrays in which, for instance, five resistors 1 are successively arranged, as shown in FIGS. 1 and 2, are formed. In the network-type resistor array of this embodiment, a die having quadrangular shaft pins 71*b*, as shown in FIG. 9B, is used as the upper die, and one having quadrangular holes corresponding to the angular shaft pins 71*b* is used as the lower die. As a result, in the network-type resistor array of the embodiment, as shown in the plan view of FIG. 1 and in the perspective view of FIG. 2, five resistors 1 are successively arranged, and the electrode portions 2 of the resistors 1 are separated by angular electrode-separating notches 3. In other words, the notch 3 between the adjacent ones of the electrode portions 2 is formed into an angular recessed configuration comprised of a bottom surface 31 and side wall surfaces 32, 33 respectively perpendicular to opposite ends of the bottom surface 31.

Figure 7:
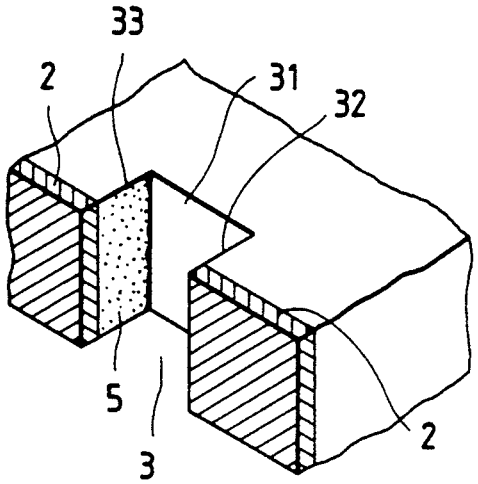
FIG. 7 is an explanatory diagram showing the state of flowing out of solder in a case where solder is applied to an electrode portion.
Figure 8:
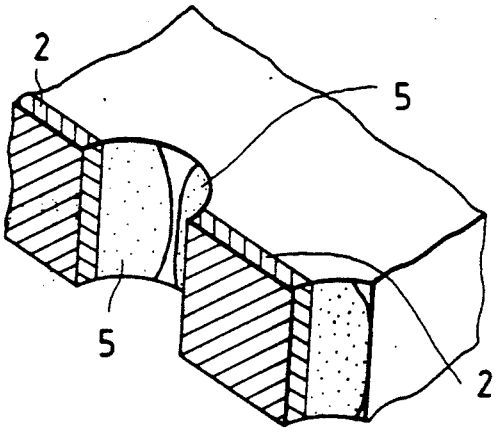
FIG. 8 PRIOR ART
FIG. 8 is an explanatory diagram showing the state of flowing out of solder in a case where solder is applied to electrode portions.

In the chip network-type resistor array having the above-described configuration, each of the electrode portions 2 of the plurality of successively arranged resistors 1 is set in an angular shape, i.e., is set adjacent to the recessed notch 3 whose three surfaces 31, 32, and 33 are orthogonal surfaces. Accordingly, when each of the electrode portions 2 is electrically connected to the common-use electrode or individual-use electrode, even if the solder 5 is applied and the amount of solder is large and the molten solder 5 flows out to the electrode-separating notch 3 as shown in FIG. 7, since the notch 3 has its three surfaces 31, 32, and 33 arranged orthogonally and is not continuous as in the case of a curved surface. Hence, the solder 5 which has flown out to the notch 3 is prevented from further flowing along since the orthogonal corner portions at where the notched side surface portion 32 and 33 and the bottom surface 31 of the notch meet with each other serve as an obstacle, thereby making it possible to overcome the risk of a short-circuiting.

Figure 10:
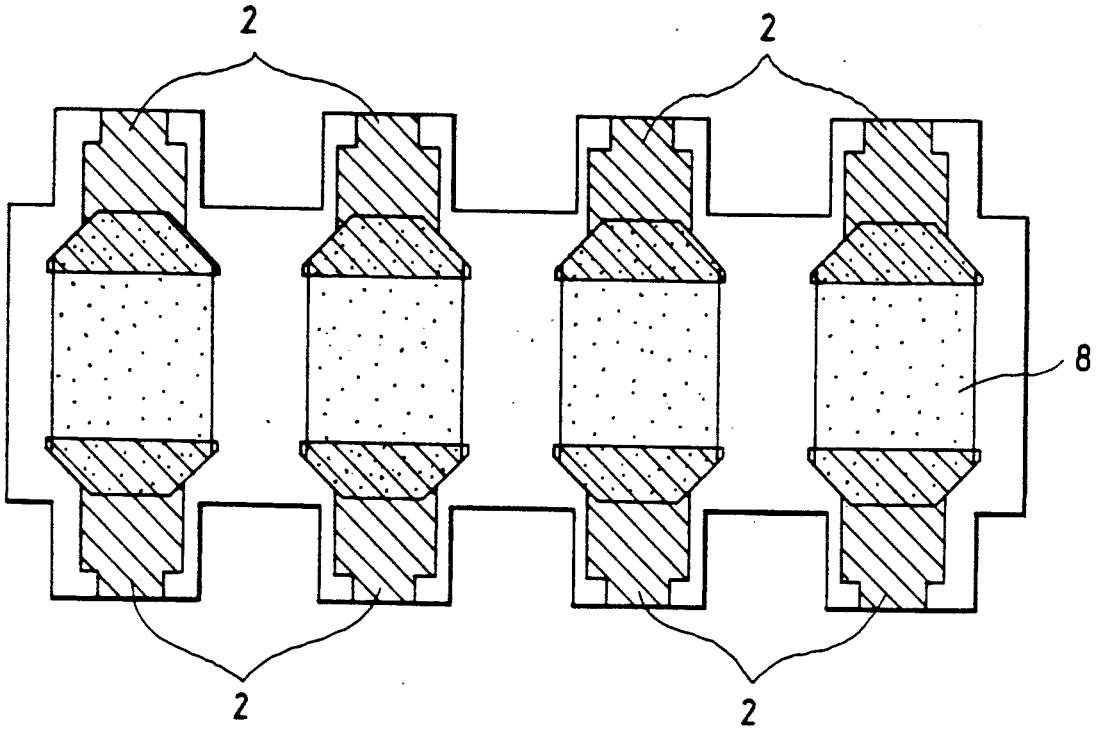
FIG. 10 is a plan view showing a chip network-type resistor array in accordance with another embodiment of the present invention.

In practical use of the invention, as shown in FIG. 10, the electrodes 2 are extended into the upper surface of the substrate at where the electrodes 2 and the resistance film layer 8 are overlapped with each other. Thereby, each of the resistors is formed.

In the present invention, as described above, since the respective electrode portions of a plurality of successively arranged resistors are separated by angular electrode-separating notches, an outstanding advantage which attains the object of the invention is offered in that even if the solder flows along when the electrode portion is electrically connected, it is possible to prevent a short-circuit of adjacent ones of the electrode portions.

What is claimed is:

1. A network-type resistor array comprising a resistory body, a plurality of resistors formed in adjacent relation in the resistor body, a plurality of electrodes mounted in spaced relation along a surface of the resistor body, and a plurality of multifaceted notches in the surface of the resistor body interposed between adjacent electrodes, each of the multifaceted notches having at least two substantially planar surface portions extending at an angle to each other.

2. A network-type resistor array according to claim 1 wherein the adjacent surface portions of the multifaceted notches extend at a right angle to each other.

3. A method for forming a network-type resistor array comprising forming a resistor body using a first die having multifaceted shaft pins and a second die having multifaceted recesses corresponding to the shape of the multifaceted shaft pins, and forming one surface of the resistor body with the shaft pins so that the surface has spaced electrode regions separated by multifaceted notches having at least two adjacent, substantially planar surface portions extending at an angle to each other.

4. A method according to claim 3 wherein the adjacent surface portions of the notch extend at right angles to each other.

* * * * *